United States Patent [19]

Hölz et al.

[11] 4,194,828

[45] Mar. 25, 1980

[54] PROCESS AND APPARATUS FOR DEVELOPING AN ELECTROSTATIC LATENT IMAGE

[75] Inventors: Rudolf Hölz, Schlangenbad; Helmuth Haberhauer, Taunusstein, both of Fed. Rep. of Germany

[73] Assignee: Hoechst Aktiengesellschaft, Frankfurt am Main, Fed. Rep. of Germany

[21] Appl. No.: 857,814

[22] Filed: Dec. 5, 1977

[30] Foreign Application Priority Data

Dec. 6, 1976 [DE] Fed. Rep. of Germany ..... 2655158

[51] Int. Cl.[2] ..... G03G 15/00

[52] U.S. Cl. ..... 355/3 DD; 118/647; 118/651; 355/14 R

[58] Field of Search ..... 118/647, 651, 653, 661; 355/3 R, 3 DD, 14; 96/1 SD; 427/13, 14, 18

[56] References Cited

U.S. PATENT DOCUMENTS

| | | | |
|---|---|---|---|
| 3,438,705 | 4/1969 | King | 355/3 DD X |
| 3,654,893 | 4/1972 | Piper et al. | 118/651 X |
| 3,788,739 | 1/1974 | Coriale | 355/3 R X |
| 3,990,394 | 11/1976 | Katakura | 118/651 X |
| 4,003,650 | 1/1977 | Courtney et al. | 118/647 X |
| 4,050,806 | 9/1977 | Miyakawa et al. | 355/14 |
| 4,089,297 | 5/1978 | Morita et al. | 118/651 X |

*Primary Examiner*—Fred L. Braun

*Attorney, Agent, or Firm*—Schwartz, Jeffery, Schwaab, Mack, Blumenthal & Koch

[57] ABSTRACT

A process and apparatus for controlling development of electrostatic latent charge images. A development electrode is utilized both to measure a background voltage of an image-free initial portion on the surface of the recording medium and to control the development voltage in accordance with the measured background voltage.

27 Claims, 7 Drawing Figures

FIG. 5
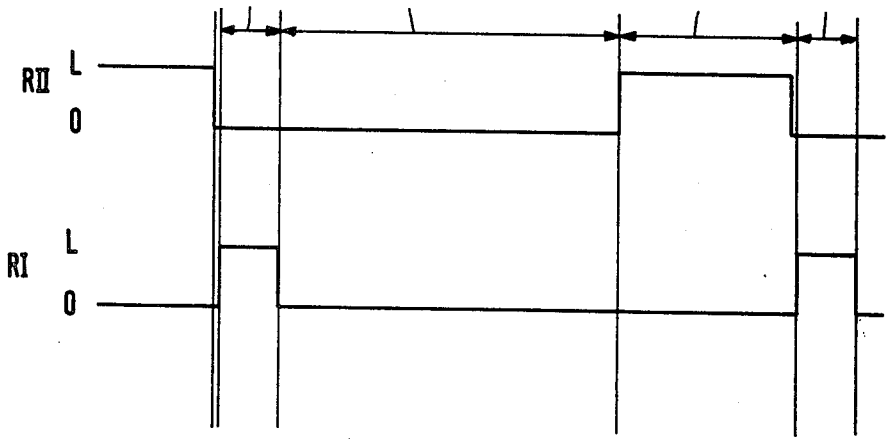
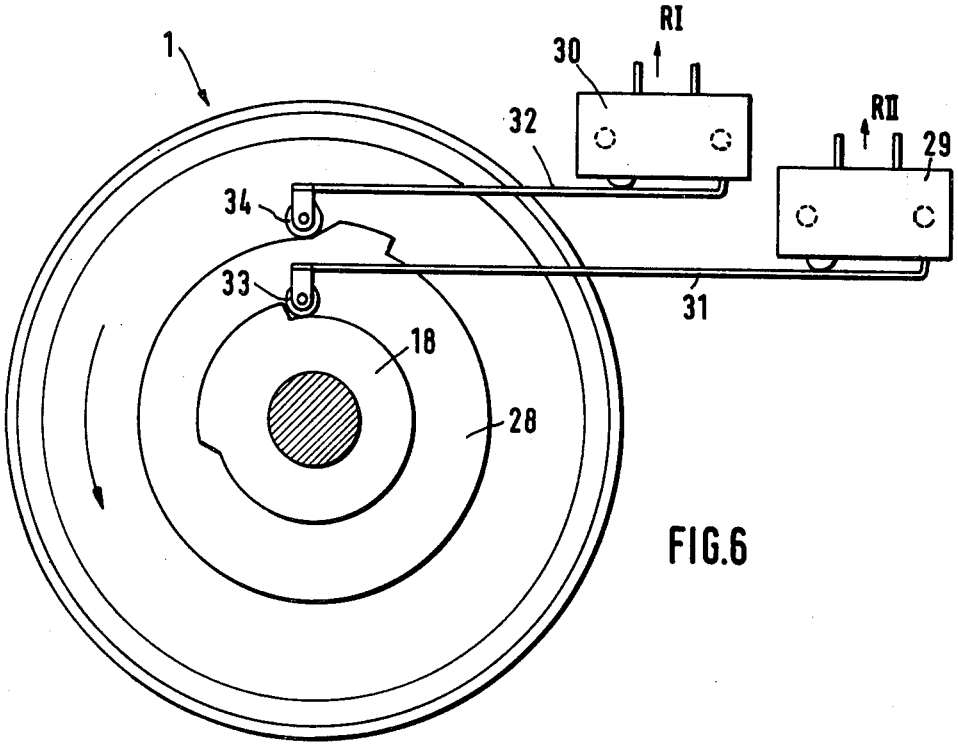
FIG.6

PROCESS AND APPARATUS FOR DEVELOPING AN ELECTROSTATIC LATENT IMAGE

BACKGROUND OF THE INVENTION

1. Field of the Invention

The invention relates to a process and apparatus for developing an electrostatic latent charge image on the surface of a recording material by means of a controlled voltage applied to a developing electrode.

2. Description of the Prior Art

There has for a long time been a need, in the development of latent electrostatic charge images, to prevent an adherence of toner to image-free places on original copies of different background brightness, while at the same time, properly developing the image areas.

In electrostatic charge images, as a result of their production, the absolute level of the voltage distribution frequently does not correspond to the values required for optimum development of the image. Thus, for example, the background area of the latent charge image, which ideally should be at zero voltage, can exhibit a residual voltage of 100 to 200 volts. The desired ideal condition can be approximated by increasing the intensity or time of the exposure. Yet, it is more economical and advantageous to effect a compensation for the residual voltage by simply raising the developing voltage by an appropriate amount. This method has the advantage that different background brightness, such as gray tones or color tones of the background of the original, can also be balanced by the compensation voltage.

This principle of controlling the developing voltage can be applied not only in electrophotography with conventional office duplicators, with laser exposure, but also in radiography and in the electrophotographic copying of drawings. In these latter two processes it is not the aim to achieve absolute freedom from background but a certain covering of toner, which permits fine nuances and small differences in density to be better perceived. Electrophotographic development processes in which the greatest achievable brightness, that is to say the maximum freedom from toner, is associated with the zone of lowest potential, are already known and are described fully in the patent literature, for example in U.S. Pat. Nos. 3,674,532, 3,782,818 and 3,892,481; U.S. patent application Ser. No. 57,654, filed July 23, 1970 and in German Offenlegungsschrift No. 2,614,318. In these processes and devices, the residual voltage of the photoconductor is in general determined by a measuring instrument and the measured signal, after suitable electrical processing, is fed to the development unit and/or the developing electrode. Processes of measuring the field, charge, voltage and current can be used in such systems.

The accurate separation, by control engineering, of the control action from the preceding measurement necessitates an expensive design, if accurate results are to be achieved.

In the development process described by U.S. Pat. No. 3,674,532 and Application Ser. No. 57,654, the voltage applied to the developing electrode is controlled in such a way that an electric charge at a voltage depending on the voltage of the charge to be developed is stored and the voltage of the developing electrode is maintained at the value preset by the stored voltage. For this purpose, a component voltage corresponding to a definite percentage of the voltage produced by the magnetic brush from its contact with the charge image, is taken off from a voltage means between the developing electrode, which is, for example, a magnetic brush, and the direct current reference line. This voltage is applied to a capacitor via a relay contact which is normally closed. When this relay contact opens, the energy feed from the voltage means to an amplifier is interrupted so that the latter is thus connected only to the capacitor. A further contact of the relay closes the amplifier circuit and permits the constant voltage stored in the capacitor to be applied to the magnetic brush after suitable amplification. Additionally, a resistor is provided, parallel to the voltage means, between the magnetic brush and the reference line, in order to prevent an undesired increase in voltage on the magnetic brush, which increase would result from the contact of the magnetic brush with a charge area of high voltage on the surface of a photoconductor. As disclosed by this U.S.-Patent the initial zone of the latent charge image has generally already had a chance to leave the region of influence of the developing device after the end of the measurement and the subsequent switchingover to control of the voltage applied to the developing electrode, so that the control voltage obtained via the measurement acts too late to become equally effective for the entire latent charge image. The result is then a copy having a starting edge which is to be ascribed to the fact that the voltage applied to the developing electrode is still uncontrolled at the beginning.

U.S. Pat. No. 3,782,818, discloses a device for preventing development of background areas resulting from an electrostatic residual voltage in a latent electrostatic charge image which has an electrode associated with a development unit and means for applying a preset voltage to the electrode. A detector scanning the surface of the photoconductor drum measures the voltage of the background. The output voltage of the detector is amplified and serves to set the voltage supplied by a source of voltage to the electrode.

The control is effected in a similar way by a device for automatically controlling the voltage of a developer electrode, as disclosed in U.S. Pat. No. 3,892,481 in which a spatial separation between the measuring zone and the developer zone is provided. For this purpose, a first electrode for measuring the voltage of the photoconductor is mounted in a wet developer trough, while the electrodes following in the running direction take over the control of the developing voltage and hence of the course of development.

A developing process and apparatus with an automatic applied voltage which is controlled with the aid of a Zener diode which is parallel to a constant current source in the circuit, is known from German Offenlegungsschrift No. 2,614,318. The Zener diode and the constant current source are connected to the developing electrode. When the average voltage of the latent charge image rises above a preset value, the weak current which is passed from the constant current source to the developing electrode is bridged or shunted by the Zener diode so that the developing electrode is prevented from being charged with an excessively high voltage.

SUMMARY OF THE INVENTION

It is thus an object of the invention to provide a process and apparatus in which the control voltage, which is obtained via the measurement and is proportional to the background voltage is applied to the developing electrode at such an early stage that the control voltage becomes effective for the entire latent charge image.

It is further an object of the invention to provide a process and apparatus for controlling the developing voltage by the background voltage of the latent electrostatic charge image, wherein no spatially separate measuring station and control station for the developing voltage are required.

According to the invention, these and other objects are achieved by measuring the background voltage of the image-free initial zone of the latent charge image and controlling the voltage applied to the developing electrode based on this measured value, before the image-free initial zone emerges again from the region of the developing electrode.

Thus, with the process of the invention, an electrostatic latent charge image having an image-free initial zone or portion on the surface of a recording material is developed by passing the recording material through a zone bordered by a developing electrode through which a voltage is applied.

As used throughout the specification and claims, the "zone" bordered by the developing electrode is intended to refer to the region in which the developing electrode exercises substantial influence over the electrostatic latent charge image. The zone will, of course, vary, depending on the proximity of the developing electrode to the image.

The background voltage of the image-free initial portion is measured before the initial portion has passed the zone. The voltage on the developing electrode is controlled before the image-free portion emerges from the zone based on the measured background voltage.

The apparatus of the invention may be used to carry out the inventive process in an effective manner. The apparatus comprises a developing electrode connected to a voltage source for applying a voltage. Means are provided within the apparatus for receiving a developer mixture. A recording material is provided which is supported on an element. A capacitive member, connected to a fixed reference voltage source, is connected to an amplifier circuit which amplifies voltages which develop on the capacitive member.

The invention achieves the advantages that the measurement of the background voltage and the control of the voltage applied to the developing electode are accomplished via the development station. Additionally, the process is not limited to electrically conductive or non-conductive developers and is largely independent of the influence of fluctuating parameters, such as, for example, fluctuations in the concentration of toner in the developer and systematic fluctuations and charge fluctuations in the electrostatic charge image. A further essential advantage of the process according to the invention is that it works successfully even if the developing zones are short in the running direction, for example only 10 mm long, as is the case in many processes using a magnetic brush. An effective control of the voltage applied to the developing electrode within such a short developing zone is achieved by a capacitive coupling of the background voltage of the charge image.

Another advantage of the inventionis that the result of the measurement of the background voltage is not susceptible to interfering voltages since it is considerably greater than the noise level of the interfering voltage pulses which customarily occur in the switch lines and feed lines.

BRIEF DESCRIPTION OF THE DRAWINGS

FIG. 5 illustrates the switching cycles of two relays which are used in the circuit arrangement according to FIGS. 1 and 2;

FIG. 6 illustrates a cross-sectional view of the drum which carries the photoconductor and is provided with switch cams for actuating the relays of the circuit arrangement.

DESCRIPTION OF THE PREFERRED EMBODIMENTS

Figure 1:
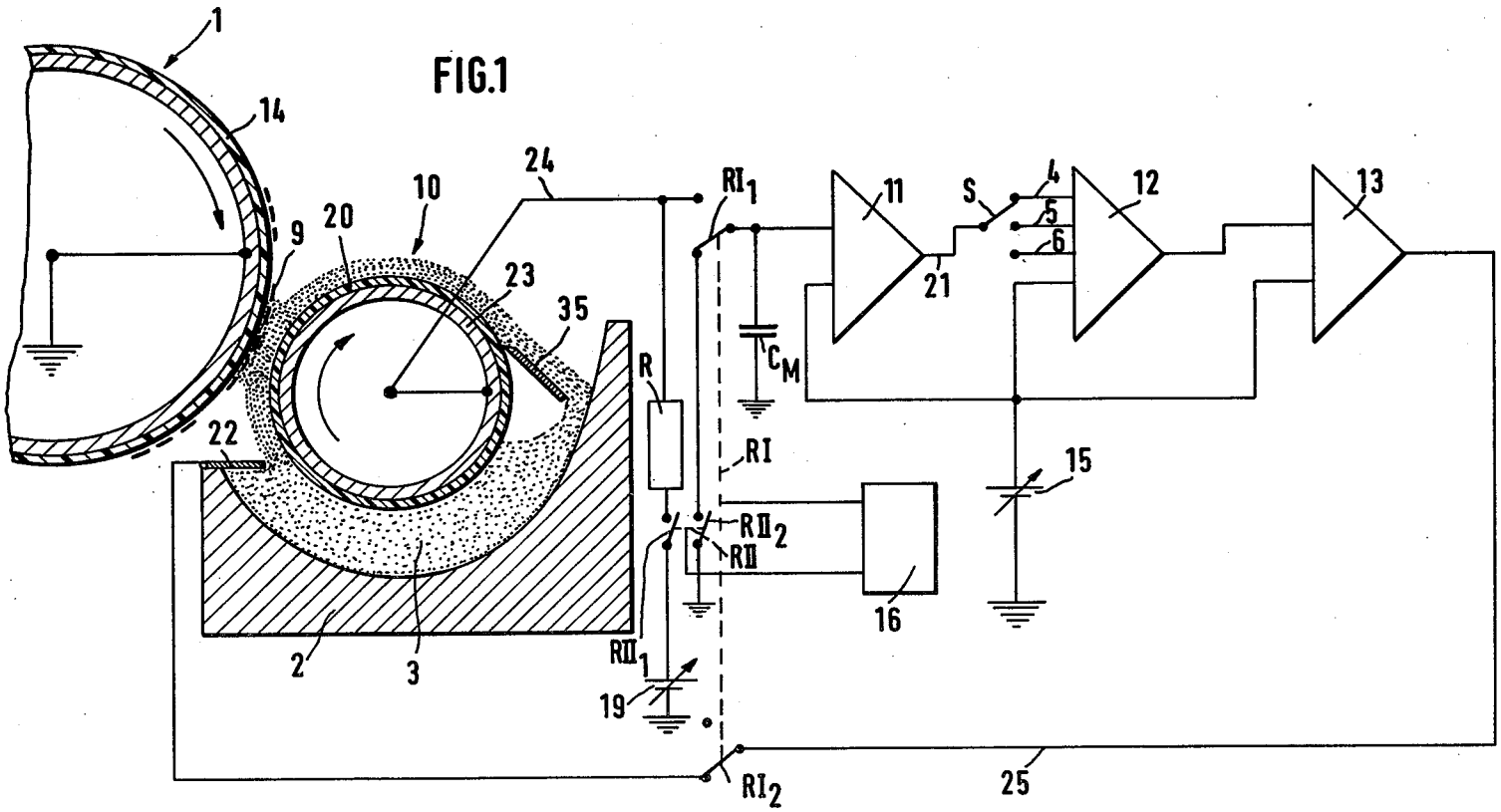
FIG. 1 illustrates, in cross-section, a developing station and a photoconductor drum as well as a circuit arrangement for the developing of charge images, according to the invention.

FIG. 1 shows a photoconductor 14 applied as the recording material on the cylindrical surface of a drum 1. The photoconductor carries a latent electrostatic charge image 9 on its outer surface which is rendered visible by means of a developer mixture 3. The developer mixture 3 is located in a storage container 2 and is transferred to the charge image 9 with the aid of a developing electrode 10 which can, for example, be a magnetic brush. The developing electrode 10 consists of a metal roller 23 on which a layer 20, for example a dielectric layer, such as an Eloxal(®)layer is applied. Generally speaking, anEloxal layer effects a shift in voltage which must be taken into account when designing the voltage of the circuit arrangement. The developer mixture 3 which has not been transferred to the photoconductor surface by the developing electrode 10 is detached from the layer 20 by a stripper blade 35 and trickles back into the storage container 2. A doctor plate 22 is attached to one boundary edge of the storage container 2 and the distance of this doctor plate from the layer 20 determines the thickness of the coating of developer mixture 3 in contact with the latent charge image 9. A line 24 connects the metal roller 23 to a first contact $RI_1$ of a first relay RI. This line 24 is also connected to a resistor R which, via a first contact $RII_1$ of a second relay RII, is connected to a voltage source 19 which preferably is a direct voltage source with a variable direct voltage. One pole of this direct voltage source is connected to ground.

In its rest position r, the first contact $RI_1$ of the first relay RI is connected to the second contact $RII_2$ of the second relay RII which is connected to ground. In its working position a, the first contact $RI_1$ of the first relay RI connects the line 24, on the one hand, to the input of an amplifier stage 11 and, on the other hand, the one electrode of a capacitive member $C_M$. The other electrode of $C_M$ is connected to ground. The output of the first amplifier 11 is connected via a connecting line 21 to a multi-pole switch S which is connected, as desired, to one of the inputs 4, 5 or 6 of a second voltage amplifier stage 12. The output of the second voltage amplfier stage 12 is connected to a third voltage amplifier stage 13. The amplifier stage 11 and the two voltage amplifier stages 12 and 13 are connected on the input side to a direct voltage source 15, whose output voltage is variable, ranging, for example, between 0 and 300 volts. This direct voltage source 15 makes it possible to vary the reference voltages of the amplifier circuit comprising amplifiers 11, 12 and 13 as required.

An output line 25 connects the output of the voltage amplifier stage 13 via a second contact $RI_2$ of the first relay RI to the doctor plate 22. A resistance connects the doctor plate to the layer 20.

In the circuit arrangement according to FIG. 1, the control of the switching phases of the two relays RI and RII can be effected via an electronic timer unit 16 which determines the switching cycles of the two relays in accordance with a fixed fed in program.

Figure 2:
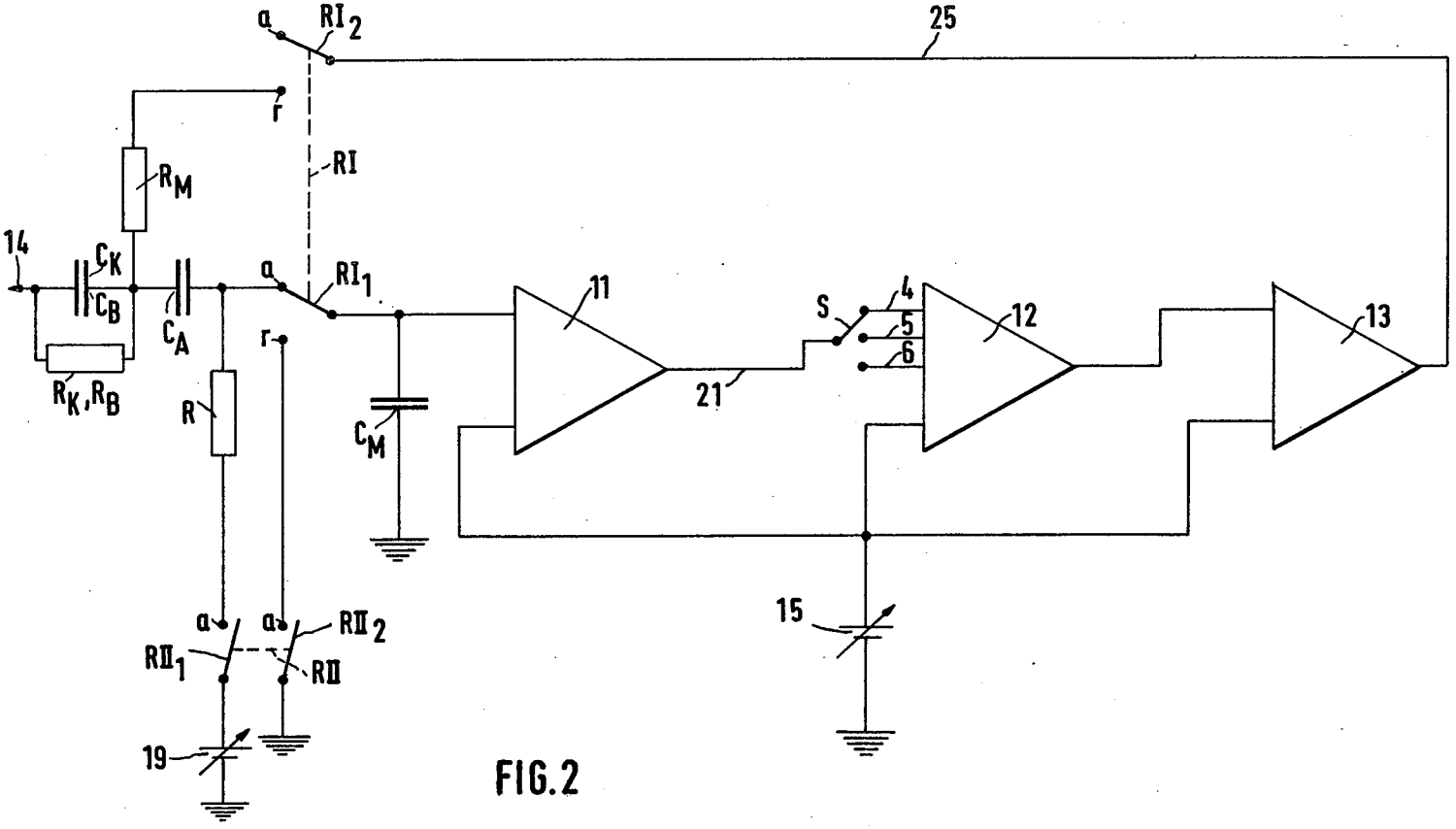
FIG. 2 illustrates an equivalent circuit diagram of the circuit arrangement according to FIG. 1.

The measurement of the background voltage and the control of the voltage applied to the developing electrode 10 will now be described in greater detail with reference to the equivalent block circuit diagram illustrated in FIG. 2.

In the alternative circuit diagram, a contact capacitance $C_K$ of the developer mixture 3 between the developing electrode 10 and the surface of the photoconductor 14; a self-capacitance $C_B$ of the developing electrode 10; and a capacitance $C_A$ of the layer 20 of the developing electrode 10 are illustrated. These capacitances are in series with the capacitance member $C_M$ which, for example, can be a capacitor having a capacitance from 1 to 2,000 pF, preferably from 50 to 150 pF. The developer mixture 3, acting as the measuring probe, with the contact capacitance $C_K$ and the self-capacitance $C_B$ of the developing electrode 10, which together possess an effective capacitance of the order of magnitude of 1 nF, is connected directly to the amplfier stage 11 or the capacitive member $C_M$ via the capacitance $C_A$ of a few nF of the layer 20 of the developing electrode 10. The measured voltage appears on the capacitive member $C_M$ as the result of a capacitive division of voltage by means of the above-mentioned chain of capacitances. Since the measured voltage is fed to the first amplifier 11 via the first relay contact $RI_1$ in its working position a, the path for the measured signal is free only for the duration of the measuring phase which is determined by the closing period of the first relay RI. During the control phase and the succeeding intermediate phase, the first relay RI is in its rest position, as can be seen from the circuit diagram, according to FIG. 5, of the two relays RI and RII. During the measuring phase and the control phase, the second relay RII is open and is closed only during the intermediate phase in its working position a, in order to apply a definite voltage to the developing station, before the start of the measuring phase, via the resistor R which is of an order of magnitude of about 10 MΩ, in order to accelerate the build-up of voltage via the capacitor chain $C_K$, $C_B$, $C_A$. After the end of the measuring phase, the first relay RI moves into its rest position r, whereby the first contact $RI_1$ of the first relay RI interrupts the supply of the measured voltage to the first amplifier 11 or to the capacitive member $C_M$. Since the first amplifier preferably has an input stage with a field-effect transistor which possesses a high input/-leakage impedance, the capacitive member $C_M$ acts as a holding capacitor with a time constant of the order of magnitude of one second to $10^4$ seconds, after the first contact $RI_1$ has moved into its rest position r.

The multi-pole switch S in the connecting line 21 between the first amplifier stage 11 and the second voltage amplifier stage 12 makes it possible to trigger one of the inputs 4, 5 or 6 of the voltage amplifier stage 12 and to amplify the output signal from the first amplifier 11 as required. In general, the second voltage amplifier stage 12 is a conventional transistor stage, the amplifying factor of which is in the range from 2 to 4. The third voltage amplifier stage 13 is designed as a final stage and delivers the control voltage via the output line 25 and via the second contact $RI_2$ of the first relay RI, which is in its rest position r, to the chain of resistances, formed by the resistances $R_M$, $R_K$ and $R_B$.

Figure 3:
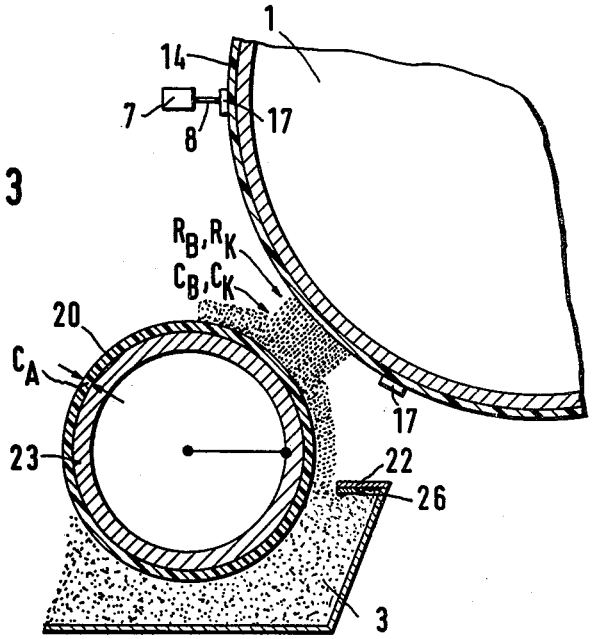
FIG. 3 illustrates a partial view of the developing electrode and a part of the photoconductor drum.

It can be seen from FIG. 3, that the resistance $R_M$ appears between the layer 20 of the developing electrode 10 and a small contact plate 26 of the doctor plate 22. Furthermore, this figure indicates at which points the capacitances $C_A$, $C_B$, and $C_K$, and the resistances $R_B$ and $R_K$ appear. For example, in the embodiment according to FIG. 3, the first and second relays are switched on or off by means of switch markings 17 which are arranged on the insulating surface of the photoconductor 14. When the drum rotates, these switch markings 17 come into contact with switch levers 8 of stationary micro-switches 7 which are thus actuated and deliver the requisite switch pulses for the relays RI and RII.

Figure 4:
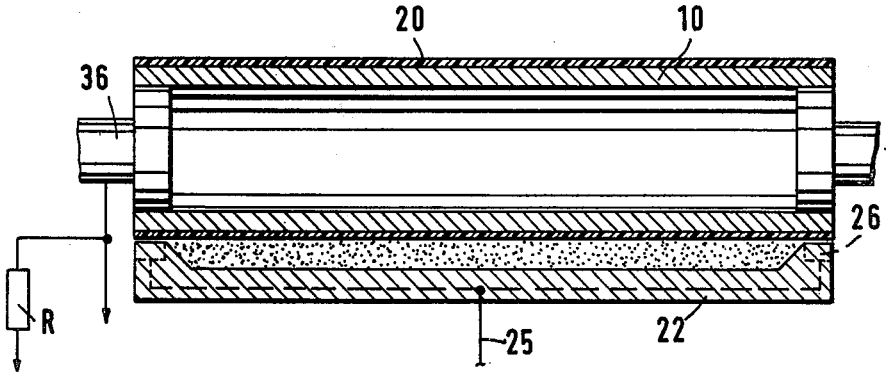
FIG. 4 illustrates a section through the developing electrode.

As shown in detail in FIG. 4, doctor plate 22 extends over the length of the developing electrode 10 and has a trough-shaped recess which is delimited at the edges by the small contact plates 26 which are directly opposite the layer 20 of the developing electrode 10. The small contact plates 26 present on either side are connected to one another and to the output line 25 in FIG. 1 via the second contact $RI_2$ of the first relay RI. FIG. 4 also indicates that a defined bias voltage is imposed on the developing electrode 10 via the resistor R during the intermediate phase, and that the measured voltage or the measured signal is tapped via a shaft 36 of the developing electrode 10, which is electrically connected to the metal roller 23. FIG. 6 diagrammatically shows a further possible arrangement for switching the two relays RI and RII. For this purpose two switch cams 18 and 28 are seated on the axis of the drum 1 and interact with rollers 33 and 34 which are fastened to one end of switch lugs 31 and 32 respectively. The switch lugs are componenets respectively, of the switches 29 and 30, whose outputs lead to the second relay RII to the first relay RI.

Figure 7:
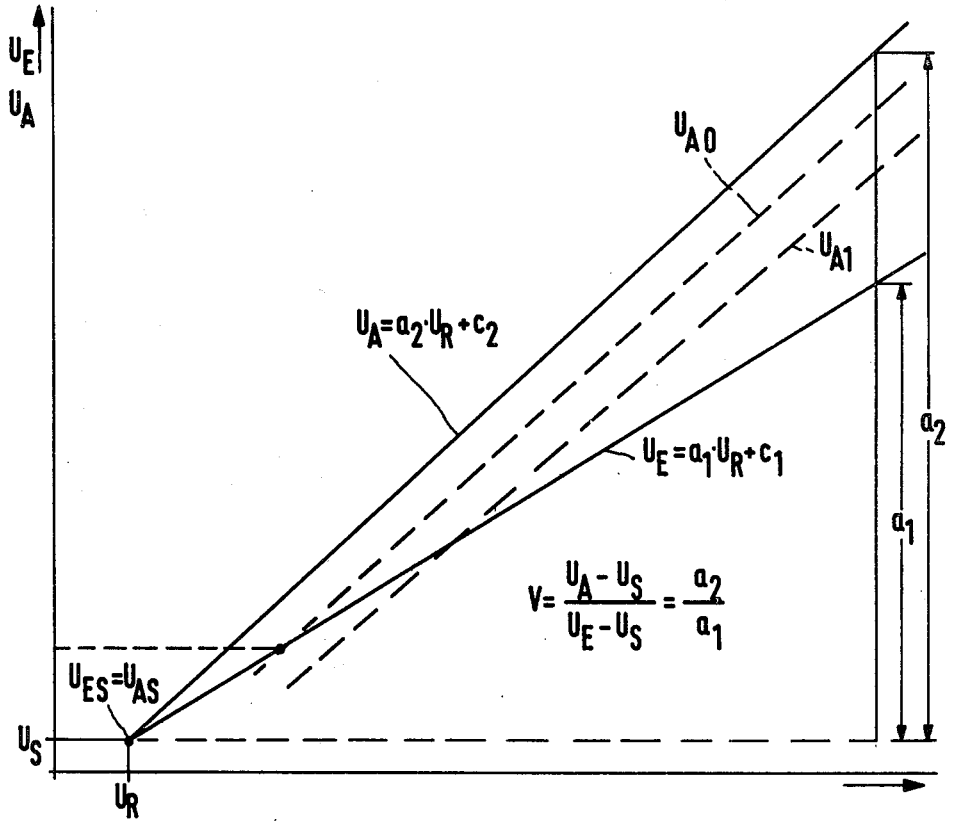
FIG. 7 illustrates the relationship between the background voltage of the photoconductor and the input and output voltages of one of the voltage amplifier stages.

FIG. 7 diagrammatically shows the relationship between the background voltage of the photoconductor 14 and the input and output voltages of the second voltage amplifier stage 12. For each background voltage of the latent charge image, which is plotted on the abscissa axis, there is an input voltage $U_E$, which is determined during the measuring phase and is applied to one of the inputs 4, 5 or 6 of the second voltage amplifier stage 12, and an output voltage $U_A$ desired for controlling the developing voltage. It is also possible that several output voltages $U_{A0}$, $U_{A1}$ and $U_{A2}$ and the like are required for differing densities of the background colors and/or a background which is as free from toner as possible. An appropriate setting of the amplifying factor $V=(U_A-U_S)/(U_E-U_S)=a_2/a_1$ of the second voltage amplifier stage 12 can have the result that the output voltage $U_A$ which in general has a steeper slope is obtained from the input voltage $U_E$ by subtracting the ordinate $U_{ES}$ of the point of intersection, multiplying with $a_2/a_1$ and adding the voltage at the point of intersection $U_{AS}=U_{ES}$.

This is done with $U_A=(a_2 \cdot U_R)+c_2$ and $U_E=(a_1 \cdot U_R)+c_1$ by substituting them in the relation of the ordinates of the point of intersection $U_{AS}-U_{ES}$, which gives $U_A=a_2/a_1(U_E-U_{ES})+U_{AS}$. Thus, the output control votage $U_A$ is obtained from the particular input measured voltage $U_E$ via steps, such as subtracting the ordinate $U_{ES}$ of the point of intersection from the input measured voltage $U_E$, multiplying this voltage difference by the amplifying factor $a_2/a_1$ and adding the voltage $U_{AS}$ at the point of intersection. This means that it is possible to manage with the aid of adding the base voltage and using a simple amplifier. This rule also applies for varying widths of the format of the charge image, which can be selected corresponding to the particular position of the multi-pole switch S.

The mode of operation of the developing device is as follows:

The latent electrostatic charge image 9 present on the photoconductor 14 is moved, for the purpose of developing, into the region or influence or zone of the developing electrode 10. In this step, the voltage of the image-free initial zone of the original is measured via the capacitive voltage coupling by means of the capacitive member $C_M$ from a point in time shortly before the edge of the latent image is introduced up to a point in time before the edge of the latent image leaves the region of influences of the developing electrode. Only a short period of time, 1/20 second, for example, is available for determining the magnitude of the measured signal. The capacitive coupling is possible with a conductive or non-conductive carrier material or toner of the developer mixture 3, as long as the capacitance of the developer mixture 3 between the surface of the charge image 9 and the developing electrode 10 is between about $10^{-11}$ to $10^{-6}$ Farad, and preferably between $10^{-10}$ and $10^{-8}$ Farad.

The advantages of the capacitive signal coupling of the invention are that a measured signal of a high value which can be between 50 and over 90% of the background voltage of the photoconductor 14 is obtained rapidly and that the dependence on outside influences is small. For example, a non-uniformity or a transient change of the insulating constituents of the developer mixture has a much smaller effect than in the case of ohmic coupling.

At the start and during the measurement, the developing electrode 10 is kept free from outside voltages—apart from an initial constant bias voltage via the resistor R—and the measured voltage is fed via the first contact $RI_1$ of the first relay RI in its working position a to the amplifier stage 11. The switch-over from the measuring phase to the immediately following control phase is fixed in time so that the control signal reaches the developing electrode 10 at such an early stage that the initial zone of the latent image is still fully covered by the region of influence of the developing electrode 10 and, thus, an undesired stripe, which is usually set off as a starting edge on the copy, is avoided. To this end, the measuring phase is ended prematurely by limiting it to a period of time, in the course of which the entering charge image fills the developing zone of the developing electrode 10 to an extent in the range from 50 to 70%, and the switch-over to the control phase then takes place immediately. Since the measured voltage widens like a trumpet on the path through the developer mixture 3 from the charge image up to the developing electrode 10, the measured voltage on the developing electrode 10 is measured in a region which approximately corresponds to a complete filling of the developing zone by the charge image. A certain deficit can be compensated for during the subsequent amplification by the voltage amplifier stages 12 and 13. If the control voltage is fed in correspondingly early, this spreads out analogously like a trumpet, in particular from the doctor plate 22 which serves as an electrode in the direction of the latent charge image 9 on the photoconductor 14 of the drum 1. In this way, a larger region is covered at the start of the image than corresponds to the direct geometric conditions. In practice, even the first edge of the latent image is here subject to an adequate control, such as corresponds to more than 50% of the geometrically defined developing zone, so that, in the end result, the requisite overlap of the measuring phase and the control phase is obtained.

Customarily, a positive image of the original to be reproduced is developed, but it is also possible to obtain a negative image. For this purpose, a precharged toner, or a one-component magnetic toner which is not precharged and in which corresponding charges are induced by the latent charge image can be used. If the toner is precharged, the negative or reversal image can be developed by corresponding setting the bias voltage or switching in a voltage and simultaneously changing the polarity of the latent charge image.

It should be understood also that the process and the device are also suitable for wet development.

The process and apparatus of the invention have been described with respect to specific types of developer electrodes, amplifiers and the like. It should be understood however that the invention is not limited to these particular embodiments and should instead by construed broadly within the scope of the claims.

What is claimed is:

1. A process for developing an electrostatic latent charge image having an image-free initial portion on the surface of a recording material which comprises the steps of:

(a) passing said recording material through a zone bordered by a developing electrode through which a voltage is applied;

(b) measuring the background voltage of said image-free initial portion before said initial portion emerges from said zone, said measuring step including using said developing electrode to measure said background voltage of said image-free initial portion; and (c) controlling the voltage on said developing electrode prior to the emergence of said image-free portion from said zone based on the measured background voltage of said image-free initial portion.

2. The process as defined by claim 1 which comprises measuring said background voltage with said electrode via a capacitive coupling.

3. The process is defined by claim 1 wherein said measuring step comprises generating measurement signals and converting same into control signals which control the voltage to said developing electrode said control signals occurring in a time interval which is short enough such that a feedback effect occurs and the voltage to the developing electrode is controlled as a function of said measured background voltage before said initial portion emerges from said zone.

4. The process as defined by claim 3, wherein said voltage is controlled by applying a supplementary voltage across said zone, said supplementary voltage being a function of said voltage being measured.

5. The process as defined by claim 4, which further comprises applying said supplementary voltage before and during the application of said voltage to said developing electrode.

6. The process as defined by claim 5, which further comprises triggering said measurement, said application of the applied voltage and the application of said supplementary voltage by means of mechanical switching elements.

7. The method as defined by claim 6, which further comprises initiating said measurement, said application of the voltage and the application of said supplementary voltage by control markings on said recording material.

8. The method as defined by claim 4, which further comprises triggering said measurement, said application of the voltage and the application of said supplementary voltage with an electronic timer unit.

9. The process as defined by claim 1, which comprises measuring said background voltage to produce a signal; amplifying said signal with an amplifier circuit; and using said amplified signal to control said voltage.

10. The process as defined by claim 9, which comprises varying the amplification factor of said amplifier circuit in response to differing widths of said recording material or of said latent image.

11. The process as defined by claim 9, which further comprises varying said voltage in response to differing widths of said recording material or said latent image.

12. The process as defined by claim 1 which further comprises developing a negative image of an original to be copied with a precharged toner by switching in a voltage and simultaneously changing the polarity of said latent charge image.

13. An apparatus for developing an electrostatic latent charge image which comprises:

(a) a developing electrode connected to a voltage source for applying a voltage to said electrode;
(b) means for receiving a developer mixture;
(c) an element supporting a recording material; and
(d) a capacitive member connected to a fixed reference voltage source, said capacitive member being arranged so that it is alternatively connected to an amplifier circuit, for amplifying voltages which develop on said capacitive member, and to said developing electrode.

14. The apparatus as defined by claim 13, wherein said amplifier circuit comprises at least three amplfiers connected together in series and the last amplifier in series is connected to said developing electrode for controlling the voltage applied across said developer mixture.

15. The apparatus as defined by claim 14, further comprising a multi-pole switch connected to one of said amplifiers of said amplifier circuit so that the amplfication of said one amplifier may be switched in response to the particular format being copied.

16. The apparatus as defined by claim 14, wherein said amplifier circuit is electrically connected to said developing electrode through a doctor plate which is arranged to extend over the length of said developing electrode.

17. The apparatus as defined by claim 16, wherein said said doctor plate is electrically connected to the output of the last amplifier and is connected to said developing electrode through a resistor.

18. The apparatus as defined by claim 14, wherein said applied voltage is connected to said developing electrode and said amplifier circuit is connected to said developing electrode through working positions of first and second respectively of a switch element.

19. The apparatus as defined by claim 18, wherein said switch element is a relay for switching said apparatus from a measuring phase, wherein the background voltage is measured, to a control phase.

20. The apparatus as defined by claim 19, wherein a further relay is provided having a first and a second contact; said first contact being connected in its working position between said source of applied voltage and said developer electrode, and said second contact being connected in its working position between ground and the rest position of said switch element contact of said first relay.

21. The apparatus as defined by claim 20, wherein said first contact of said further relay connects, in its working position, said source for providing an applied voltage with a resistor through which said applied voltage can be applied to said developing electrode.

22. The apparatus as defined by claim 21, wherein said developing electrode comprises a metal roller and said resistor is electrically connected to said metal roller.

23. The apparatus as defined by claim 20, further comprising an electronic timer unit for controlling the opening and closing of the first and second contacts of said relays.

24. The apparatus as defined by claim 20, further comprising switch markings on said recording material.

25. The apparatus as defined by claim 20, wherein each of said relays is connected to one end of a switch lug; each of said switch lugs having a roller at an end spaced from said relays; and each of said rollers rests on cams mounted around the axis of said element supporting said recording material, such that when said element rotates, said lugs are moved to open and close said relays.

26. The apparatus as defined by claim 13, wherein said recording material is a photoconductor and said means for receiving a developer mixture contains a developer mixture; and said apparatus further comprises a photoconductor, and a layer surrounding said developing electrode; and wherein the contact capacitance of said developer mixture between said developing electrode and the surface of said photoconductor, the self-capacitance of said developing electrode and the capacitance of said layer on said developing electrode are in series with said capacitive member thus forming a capacitive voltage divider.

27. The apparatus as defined by claim 13, wherein said capacitive member has a capacitance of 1 to 1000 pF and said amplifier circuit has an input/leakage impedance such that the resulting time constant for the member is 1 to $1\times10^4$ seconds.

* * * * *

UNITED STATES PATENT AND TRADEMARK OFFICE

CERTIFICATE OF CORRECTION

PATENT NO. : 4,194,828

DATED : March 25, 1980

INVENTOR(S) : Rudolf HOLZ et al

It is certified that error appears in the above-identified patent and that said Letters Patent are hereby corrected as shown below:

Column 3, line 48, "electode" should read --electrode--;

Column 3, line 65, "inventionis" should read --invention is--;

Column 4, line 39, "Eloxal(R)" should read --Eloxal(R)--;

Column 4, line 40, "anEloxal" should read --an Eloxal--;

Column 5, line 38, "amplfier" should read --amplifier--;

Column 6, line 49, "componenets" should read --components--;

Column 6, line 50, between "RII" and "to" the word --and-- should be inserted

Column 7, line 9, "votage" should read --voltage--;

Column 7, line 31, "influences" should read --influence--;

Column 8, line 28, "corresponding" should read --correspondingly--;

Column 8, line 37, the word after "instead" should read --be--;

UNITED STATES PATENT AND TRADEMARK OFFICE

CERTIFICATE OF CORRECTION

PATENT NO. : 4,194,828

DATED : March 25, 1980

INVENTOR(S) : Rudolf HOLZ et al

It is certified that error appears in the above-identified patent and that said Letters Patent are hereby corrected as shown below:

Column 9, line 53, "amplfiers" should read --amplifiers--;

Column 9, lines 60/61, "amplfication" should read --amplification--; and

Column 10, line 4, the word "said" should be cancelled once.

Signed and Sealed this

*Thirtieth* Day of *December 1980*

[SEAL]

*Attest:*

SIDNEY A. DIAMOND

*Attesting Officer*

*Commissioner of Patents and Trademarks*